US008388105B2

(12) United States Patent
Yokota

(10) Patent No.: US 8,388,105 B2
(45) Date of Patent: Mar. 5, 2013

(54) IMAGE FORMATION APPARATUS AND INKJET RECORDING APPARATUS

(75) Inventor: Kenji Yokota, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 204 days.

(21) Appl. No.: 12/901,182

(22) Filed: Oct. 8, 2010

(65) Prior Publication Data

US 2011/0085007 A1 Apr. 14, 2011

(30) Foreign Application Priority Data

Oct. 9, 2009 (JP) ..... 2009-235158

(51) Int. Cl.
*B41J 2/135* (2006.01)
*B41J 3/00* (2006.01)
*B41J 23/00* (2006.01)

(52) U.S. Cl. ..... 347/44; 347/4; 347/38

(58) Field of Classification Search ..... 347/38, 347/160

See application file for complete search history.

(56) References Cited

U.S. PATENT DOCUMENTS 6,513,434 B1 * 2/2003 Nakazawa et al. ..... 101/466

FOREIGN PATENT DOCUMENTS

JP 54-6541 A 1/1979
JP 2000-326478 A 11/2000

* cited by examiner

*Primary Examiner* — K. Feggins
*Assistant Examiner* — Lisa M Solomon
(74) *Attorney, Agent, or Firm* — Birch, Stewart, Kolasch & Birch, LLP

(57) ABSTRACT

The image formation apparatus includes: a cylindrical conveyance member which conveys a recording medium in a conveyance direction while rotating in a state where the recording medium is held by suction on a circumferential surface of the cylindrical conveyance member; a liquid ejection head which ejects liquid from an ejection face thereof toward the recording medium being conveyed by the cylindrical conveyance member; and an ejection face protective device which includes a restricting member which restricts floating up of the recording medium by coming in contact with the recording medium at a position in a first region between the ejection face of the liquid ejection head and the circumferential surface of the cylindrical conveyance member or a second region adjacent to the first region, when the recording medium is released from the suction toward the circumferential surface of the cylindrical conveyance member while being conveyed by the cylindrical conveyance member.

8 Claims, 12 Drawing Sheets

IMAGE FORMATION APPARATUS AND INKJET RECORDING APPARATUS

BACKGROUND OF THE INVENTION

1. Field of the Invention

The present invention relates to an image formation apparatus and an inkjet recording apparatus, and more particularly to an image formation apparatus and an inkjet recording apparatus wherein the ejection face of a liquid ejection head is protected.

2. Description of the Related Art

Japanese Patent Application Publication No. 54-006541 discloses a protecting device of an inkjet head, which maintains a power supply to an apparatus main body until the inkjet head returns to its home position, when the power supply has turned off during travel of the inkjet head.

An inkjet recording apparatus carries out recording onto paper by a liquid ejection head while holding the paper by suction and conveying the held paper. In the event of an abnormality (abnormal halt) or an interruption of the power supply in the inkjet recording apparatus, it is not possible to maintain a power supply to the apparatus main body with the device disclosed in Japanese Patent Application Publication No. 54-006541, and hence there is a risk that the paper is not kept held by suction, then floats up and comes into contact with an ejection face of the liquid ejection head.

Japanese Patent Application Publication No. 2000-326478 discloses a printing apparatus having a shutter which is opened during image formation, and the image formation is carried out by advancing an inkjet head up to an image formation position, whereas when not performing image formation, the inkjet head is accommodated inside a cover and the shutter is closed. However, since the shutter is opened during image formation, there is a similar risk of the paper coming in contact with the ejection face of the liquid ejection head. Moreover, the shutter mechanism is disadvantageous because it is bothersome when carrying out maintenance of the ejection face, requires a large installation space, thus making the apparatus large in size, and increases costs.

Although it might be possible to withdraw a liquid ejection head from a paper suction conveyance device to a withdrawn position in the event of an abnormality or an interruption of the power supply, the paper comes into contact with the ejection face if the floating up of the paper from the suction conveyance device occurs earlier than the withdrawal of the head from the suction conveyance device to the withdrawal position.

In many cases, the paper is coated with treatment liquid in advance of the image formation, and if the paper comes into contact with the ejection face of the liquid ejection head, the ink in the liquid ejection head reacts with the treatment liquid on the paper and solidifies, thus causing critical damage to the liquid ejection head.

SUMMARY OF THE INVENTION

The present invention has been contrived in view of these circumstances, an object thereof being to provide an image formation apparatus and an inkjet recording apparatus whereby the ejection face of a liquid ejection head can be protected in the event of an abnormality or an interruption of the power supply.

In order to attain the aforementioned object, the present invention is directed to an image formation apparatus, comprising: a cylindrical conveyance member which conveys a recording medium in a conveyance direction while rotating in a state where the recording medium is held by suction on a circumferential surface of the cylindrical conveyance member; a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member in a state where the recording medium is being conveyed by the cylindrical conveyance member.

According to this aspect of the present invention, since the ejection face protective device including the restricting member which restricts floating up of the recording medium by coming in contact with the recording medium in between the ejection face of the liquid ejection head and the circumferential surface of the cylindrical conveyance member or the adjacent region thereof, then it is possible to protect the ejection face of the liquid ejection head in the event of an abnormality or an interruption of the power supply.

Preferably, the ejection face protective device is fixed at the position in the one of the first region and the second region.

According to this aspect of the present invention, since the ejection face protective device is fixed at the position between the ejection face of the liquid ejection head and the circumferential surface of the cylindrical conveyance member or the adjacent region thereof, then the position of restricting the floating up of the recording medium is stable and it is possible to protect the ejection face of the liquid ejection head in the event of an abnormality or an interruption of the power supply more reliably.

Alternatively, it is also preferable that the image formation apparatus further comprises: a movement device which changes a relative positional relationship of the ejection face protective device and the ejection face of the liquid ejection head, wherein when the recording medium is released from the suction toward the circumferential surface of the cylindrical conveyance member, the movement device moves the ejection face protective device to the position in the one of the first region and the second region.

According to this aspect of the present invention, since the ejection face protective device is moved to the position between the ejection face of the liquid ejection head and the circumferential surface of the cylindrical conveyance member or the adjacent region thereof, when the suction of the recording medium by the cylindrical conveyance member is halted (i.e., the recording medium is released from the suction toward the circumferential surface of the cylindrical conveyance member), then it is possible to restrict the floating up of the recording medium reliably in between the ejection face of the liquid ejection head and the circumferential surface of the cylindrical conveyance member or the adjacent region thereof, and it is possible to protect the ejection face of the liquid ejection head in the event of an abnormality or an interruption of the power supply more reliably.

Preferably, the restricting member is disposed through an entire length of the liquid ejection head in a direction perpendicular to the conveyance direction of the recording medium.

According to this aspect of the present invention, since the restricting member is arranged through the entire length of the liquid ejection head in the direction perpendicular to the conveyance direction of the recording medium, then it is possible to restrict floating up of the recording medium throughout the entire width of the recording medium.

Preferably, the restricting member includes two first pipe members and a second pipe member bridging the two first pipe members, each of the two first pipe members having a shape following the circumferential surface of the cylindrical conveyance member along the conveyance direction of the recording medium in the periphery of the ejection face of the liquid ejection head.

According to this aspect of the present invention, it is possible to dispose the restricting member in a narrow gap around the liquid ejection head.

Alternatively, it is also preferable that the restricting member includes a mesh-shaped member, the mesh-shaped member having an aperture which has a shape similar to the ejection face of the liquid ejection head and is larger than the ejection face of the liquid ejection head.

According to this aspect of the present invention, it is possible to move the liquid ejection head relatively with respect to the restricting member and withdraw the liquid ejection head from the cylindrical conveyance member, in the direction in which the liquid ejection head faces the cylindrical conveyance member.

Preferably, the liquid ejection head is a line head in which a plurality of liquid ejection ports are arranged in the ejection face; a lengthwise direction of the line head is perpendicular to the conveyance direction of the recording medium; and the restricting member is a plate member formed on a side face of the line head in the lengthwise direction.

According to this aspect of the present invention, it is possible to restrict floating up of the recording medium through the whole length of the line head.

Preferably, the restricting member is arranged at a position on either one side of the liquid ejection head in terms of the conveyance direction of the recording medium.

According to this aspect of the present invention, it is possible to protect the ejection face more reliably by means of a small number of restricting members, and the installation space can be minimized and the costs can be reduced.

Preferably, the restricting member is arranged at a position on a rear side of the liquid ejection head in terms of the conveyance direction of the recording medium.

According to this aspect of the present invention, it is possible to protect the ejection face of the liquid ejection head reliably, even if the trailing end of the recording medium in terms of the conveyance direction floats up in the event of an abnormality or an interruption of the power supply.

Alternatively, it is also preferable that the restricting member is arranged to encompass positions on both sides of the liquid ejection head in terms of the conveyance direction of the recording medium.

According to this aspect of the present invention, since floating up of the recording medium is restricted from positions on either side of the liquid ejection head in terms of the conveyance direction of the recording medium, then it is possible to protect the ejection face of the liquid ejection head reliably, even if the leading end of the recording medium in the conveyance direction, or the whole of the recording medium, floats up in the event of an abnormality or an interruption of the power supply.

Preferably, the image formation apparatus comprises a plurality of the liquid ejection heads, wherein the restricting member is arranged at a position on a rear side of a rearmost one of the plurality of the liquid ejection heads in terms of the conveyance direction of the recording medium.

According to this aspect of the present invention, it is possible to protect the ejection faces of the liquid ejection heads by means of the minimum number of restricting members, and the installation space can be minimized and costs can be reduced.

In order to attain the aforementioned object, the present invention is also directed to an inkjet recording apparatus, comprising: a treatment liquid deposition unit which deposits treatment liquid onto a recording medium; an image formation unit including a cylindrical conveyance member which conveys the recording medium on which the treatment liquid has been deposited by the treatment liquid deposition unit, in a conveyance direction while rotating in a state where the recording medium is held by suction on a circumferential surface of the cylindrical conveyance member, an ink ejection head which ejects ink from an ejection face thereof toward the recording medium being conveyed by the cylindrical conveyance member, and an ejection face protective device which is disposed in a periphery of the ejection face of the ink ejection head, the ejection face protective device including a restricting member which restricts floating up of the recording medium by coming in contact with the recording medium at a position in one of a first region between the ejection face of the ink ejection head and the circumferential surface of the cylindrical conveyance member, and a second region adjacent to the first region, when the recording medium is released from the suction toward the circumferential surface of the cylindrical conveyance member in a state where the recording medium is being conveyed by the cylindrical conveyance member; and a drying unit which dries the ink having been deposited on the recording medium in the image formation unit.

According to the present invention, it is possible to protect the ejection face of the liquid ejection head in the event of an abnormality or an interruption of the power supply.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Inkjet Recording Apparatus (Principally, Image Formation Unit)

Figure 1:
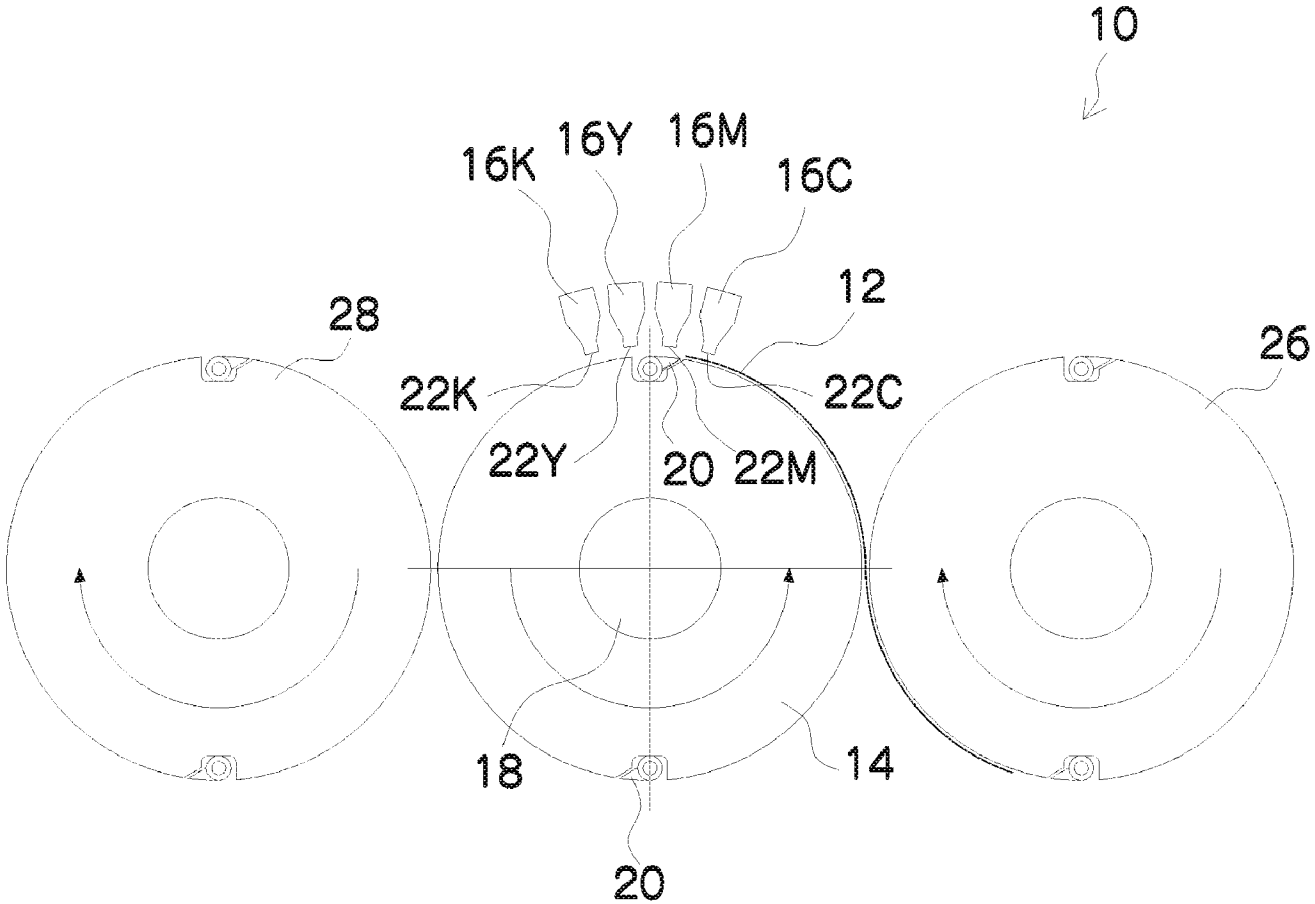
FIG. 1 is a schematic side view diagram showing the composition of the periphery of an image formation unit in an inkjet recording apparatus according to an embodiment of the present invention.
Figure 2:
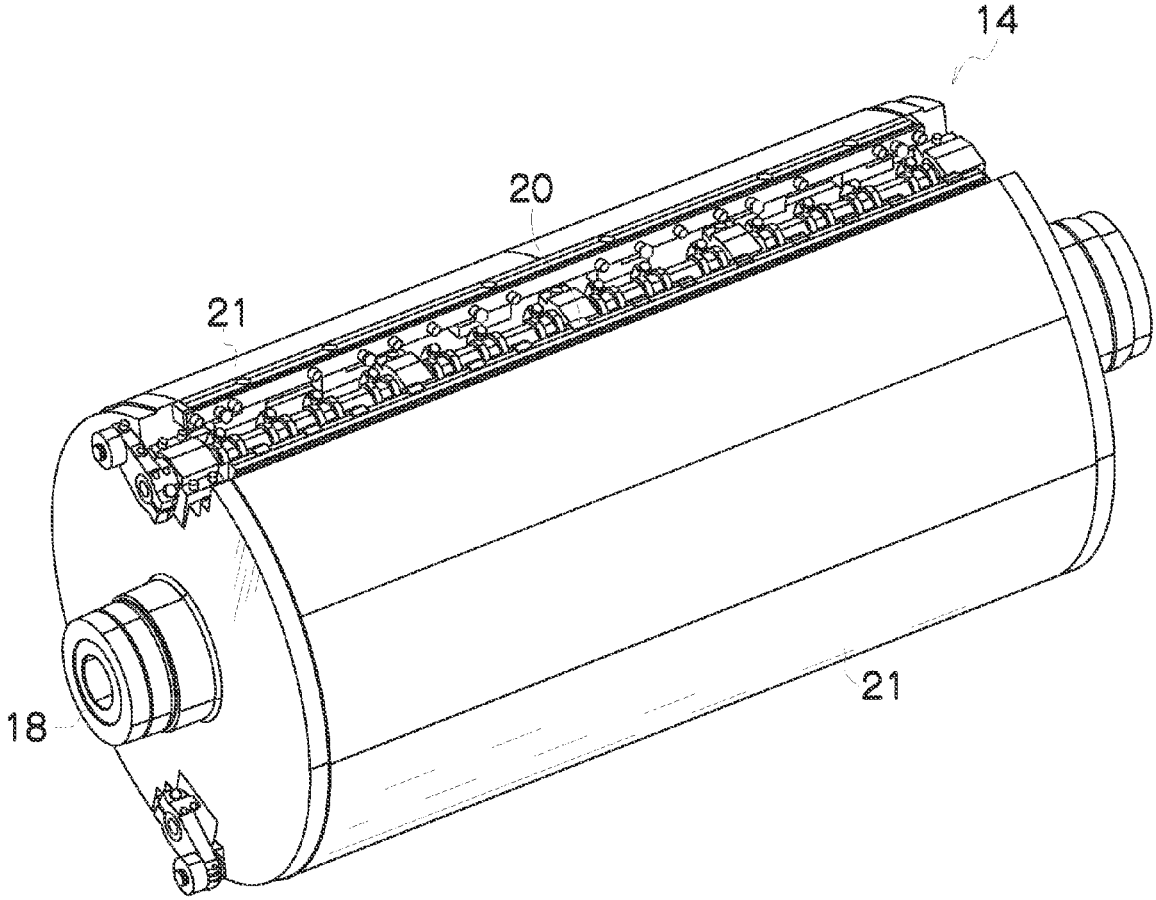
FIG. 2 is a detailed diagram of an image formation drum.

FIG. 1 is a schematic side view diagram showing the composition of the periphery of an image formation unit in an inkjet recording apparatus in which an image formation apparatus according to an embodiment of the present invention is employed in the image formation unit. FIG. 2 is a detailed diagram of an image formation drum.

In the image formation unit 10 of the inkjet recording apparatus according to the present embodiment, paper (recording medium) 12 is conveyed in rotation by being held by suction on the circumferential surface of an image formation drum 14 as shown in FIG. 1.

A color image is formed on a recording surface of the paper 12 by ejecting and depositing droplets of inks of respective colors of cyan (C), magenta (M), yellow (Y) and black (K) onto the paper 12 conveyed in rotation by the image formation drum 14, from four line heads 16C, 16M, 16Y and 16K, which are arranged about the periphery of the image formation drum 14 with their nozzle faces (ejection faces) facing the image formation drum 14. Each of the line heads 16C, 16M, 16Y and 16K is a liquid ejection head, in which a plurality of nozzles are arranged in a lengthwise direction on the nozzle face.

As shown in FIG. 2, the image formation drum 14 is a conveyance member formed in a cylindrical shape, and conveys the paper 12 in rotation. The image formation drum 14 has a rotating shaft 18 arranged so as to project from both ends of the image formation drum 14. The rotating shaft 18 is supported on bearings arranged in a main frame (not shown) of the inkjet recording apparatus 10, whereby the image formation drum 14 is installed in a horizontal attitude. A motor is coupled to the rotating shaft 18 through a rotation transmission mechanism (not shown), and the image formation drum 14 is rotated by being driven by this motor.

The image formation drum 14 has grippers 20 arranged on the circumference thereof (in the present embodiment, at two locations on the circumference), as shown in FIGS. 1 and 2. The leading end part of the paper 12 is gripped by the gripper 20 and thereby held on the circumferential surface of the image formation drum 14.

The image formation drum 14 is provided with a suction sheet 21, which constitutes the circumferential surface of the image formation drum 14. The suction sheet 21 is formed with a large number of suction holes (not shown) in a prescribed arrangement pattern, through which air is drawn toward the interior of the image formation drum 14. The paper 12 wrapped about the circumferential surface of the image formation drum 14 is held by suction on the circumferential surface of the image formation drum 14 by the suction of air through the suction holes toward the interior of the image formation drum 14.

The line heads 16C, 16M, 16Y and 16K have nozzle faces 22C, 22M, 22Y and 22K, respectively. As described later, a protective guide 38 or 40 (see FIGS. 4A to 6) is arranged in the periphery of the nozzle faces 22C, 22M, 22Y and 22K at a position to have a prescribed clearance from the circumferential surface of the image formation drum 14. The protective guide 38 or 40 serves as a protective device corresponding to a restricting member which restricts floating up of the paper 12 by coming in contact with the paper 12 in between the circumferential surface of the image formation drum 14 and the nozzle faces 22C, 22M, 22Y and 22K, or an adjacent region thereof. It is also possible to arrange a set of protective plates 44C, 44M, 44Y and 44K (see FIGS. 11A and 11B) as the protective device. The details of these protective devices are described later.

In the inkjet recording apparatus according to the present embodiment, the paper 12 is transferred to the image formation drum 14 through a conveyance drum 26 from the preceding stage (for example, a stage of depositing treatment liquid, which has a function of aggregating the coloring material in the ink, onto the recording surface of the paper 12). The conveyance drum 26 is disposed in parallel with the image formation drum 14, and transfers the paper 12 onto the image formation drum 14 in a synchronized fashion.

The paper 12 after the image formation is transferred to the succeeding stage (for example, a stage of drying the deposited ink) through a conveyance drum 28. The conveyance drum 28 is disposed in parallel with the image formation drum 14, and receives paper 12 from the image formation drum 14 in a synchronized fashion.

The four line heads 16C, 16M, 16Y and 16K have lengths corresponding to the paper width, and are radially arranged at uniform intervals apart on a circle concentric with the rotating shaft 18 of the image formation drum 14. The nozzle faces 22C, 22M, 22Y and 22K of the line heads 16C, 16M, 16Y and 16K are positioned so as to face the circumferential surface of the image formation drum 14, and are disposed at a prescribed height from the circumferential surface of the image formation drum 14 (i.e., there is a uniform clearance between the circumferential surface of the image formation drum 14 and each of the nozzle faces 22C, 22M, 22Y and 22K). The nozzle rows formed on the nozzle faces 22C, 22M, 22Y and 22K are arranged perpendicularly with respect to the direction of conveyance of the paper 12. Ink droplets are ejected perpendicularly toward the circumferential surface of the image formation drum 14 from the nozzle rows, which are formed on the nozzle faces 22C, 22M, 22Y and 22K of the line heads 16C, 16M, 16Y and 16K thus disposed.

Figure 3:
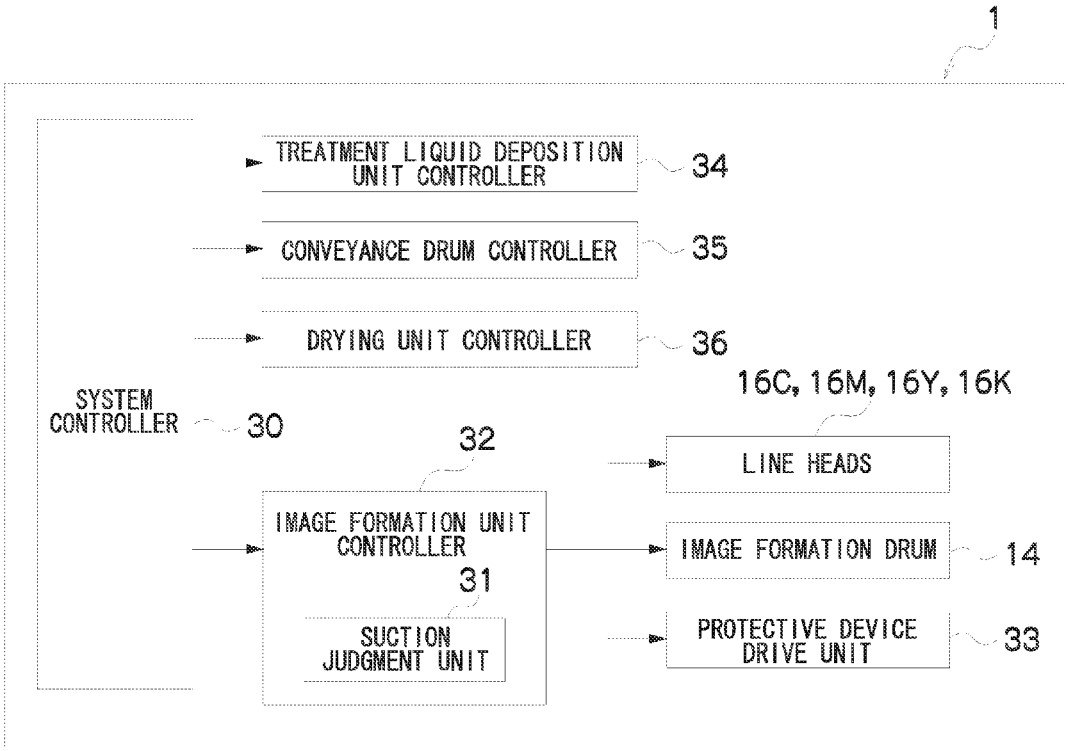
FIG. 3 is a block diagram showing the composition of a control unit in the inkjet recording apparatus according to the embodiment of the present invention.

FIG. 3 is a block diagram showing the composition of a control unit in the inkjet recording apparatus 1, which employs the image formation apparatus 10 in the embodiment of the present invention. As shown in FIG. 3, the inkjet recording apparatus 1 includes a system controller 30, an image formation unit controller 32, a treatment liquid deposition unit controller 34, a conveyance drum controller 35, a drying unit controller 36, and the like.

The system controller 30 is constituted of a central processing device (CPU), a peripheral circuit thereof, and the like, and functions as a control device which controls the whole of the inkjet recording apparatus 1 in accordance with a prescribed program.

The image formation unit controller 32 controls the line heads 16C, 16M, 16Y and 16K, the image formation drum 14, and a protective device drive unit 33 on the basis of commands from the system controller 30. The image formation unit controller 32 includes a suction judgment unit 31, which judges the operation and halt of the suction in the image formation drum 14.

In the present embodiment, for example, it is possible to control the line heads 16C, 16M, 16Y and 16K by means of the image formation unit controller 32 in such a manner that the line heads 16C, 16M, 16Y and 16K are moved toward the image drum 14 so as to become closer to the circumferential surface of the image formation drum 14, or the line heads 16C, 16M, 16Y and 16K are moved so as to become further distanced from the circumferential surface of the image formation drum 14.

The image formation unit controller 32 also controls the protective device drive unit 33, which is a movement device that changes the relative positions of the protective device and the nozzle faces 22C, 22M, 22Y and 22K, on the basis of commands from the system controller 30, and is able to move the protective device toward the image formation drum 14 so as to become closer to the circumferential surface of the image formation drum 14 or to move the protective device so as to become further distanced from the circumferential surface of the image formation drum 14. It is also possible to adopt an embodiment in which the protective device is not moved, as described below, and in this case, the inkjet recording apparatus 1 does not need to be provided with the protective device drive unit 33.

The treatment liquid deposition unit controller 34 controls a drum and a treatment liquid deposition device in a treatment liquid deposition unit (not shown), which is used in the stage (for example, the stage of depositing the treatment liquid onto the recording surface of paper 12) preceding to the image formation unit 10.

The conveyance drum controller 35 controls the conveyance drum 26, which transfers the paper 12 to the image formation drum 14, and the conveyance drum 28, which receives the paper 12 from the image formation drum 14.

The drying unit controller 36 controls a drum and a drying device in a drying unit (not shown), which is used in the stage (for example, the stage of drying the ink) succeeding to the image formation unit 10.

The periphery of the image formation unit 10 of the inkjet recording apparatus 1 is composed as described above. This image formation unit 10 has an action as described below.

In the image formation unit 10, the paper 12 is received onto the image formation drum 14 through the conveyance drum 26 from the preceding stage, and is conveyed in rotation while being held by suction on the circumferential surface of the image formation drum 14. In the course of this conveyance, the paper 12 passes below the line heads 16C, 16M, 16Y and 16K, and the ink droplets ejected from the line heads 16C, 16M, 16Y and 16K during conveyance land on the recording surface of the paper 12 and form a color image on the recording surface of the paper 12. After having completed the image recording, the paper 12 is transferred from the image formation drum 14 to the conveyance drum 28 and is conveyed to the succeeding stage.

The line heads 16C, 16M, 16Y and 16K are arranged movably between the image formation position and a maintenance position, in the direction (horizontal direction) parallel to the rotating shaft 18 of the image formation drum 14. When the line heads 16C, 16M, 16Y and 16K are disposed in the image formation position, they are arranged about the periphery of the image formation drum 14 and assume the state capable of image formation. On the other hand, when the line heads 16C, 16M, 16Y and 16K are disposed in the maintenance position, they are withdrawn from the image formation drum 14. A moisturizing unit (not shown) for moisturizing the line heads 16C, 16M, 16Y and 16K is arranged in the maintenance position. If not used for a long period of time, the line heads 16C, 16M, 16Y and 16K are situated in the maintenance position, and the line heads 16C, 16M, 16Y and 16K are kept moisturized by the moisturizing unit. By this means, ejection failure due to drying is prevented.

A head cleaning unit (not shown) for cleaning the nozzle faces 22C, 22M, 22Y and 22K of the line heads 16C, 16M, 16Y and 16K is arranged between the image formation position and the maintenance position. When the line heads 16C, 16M, 16Y and 16K are moved from the image formation position to the maintenance position, wiping webs in the head cleaning unit are pressed against the nozzle faces 22C, 22M, 22Y and 22K, whereby the nozzle faces 22C, 22M, 22Y and 22K are wiped and cleaned.

Description of Protective Device

Next, the protective devices according to embodiments of the present invention are described.

First Embodiment

Figure 4A:
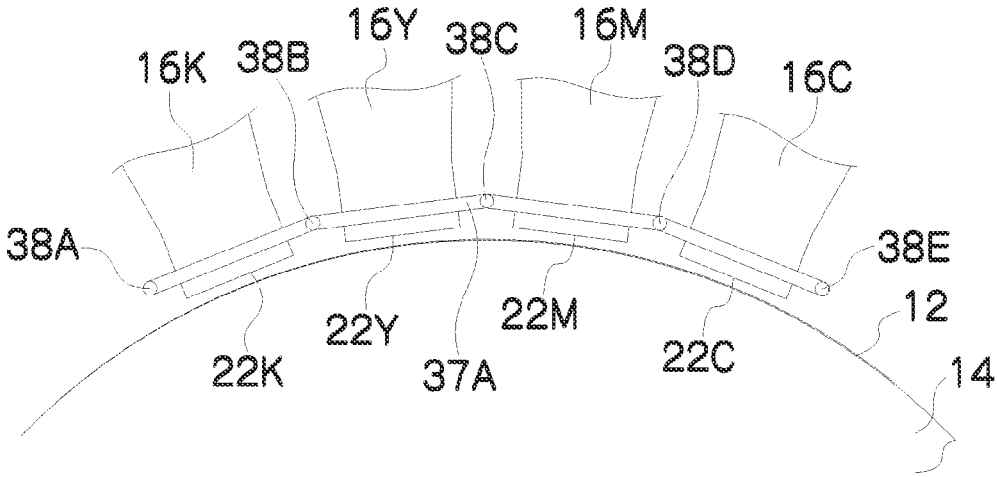
FIGS. 4A and 4B are schematic front views of the periphery of the circumferential surface of the image formation drum.
Figure 4B:
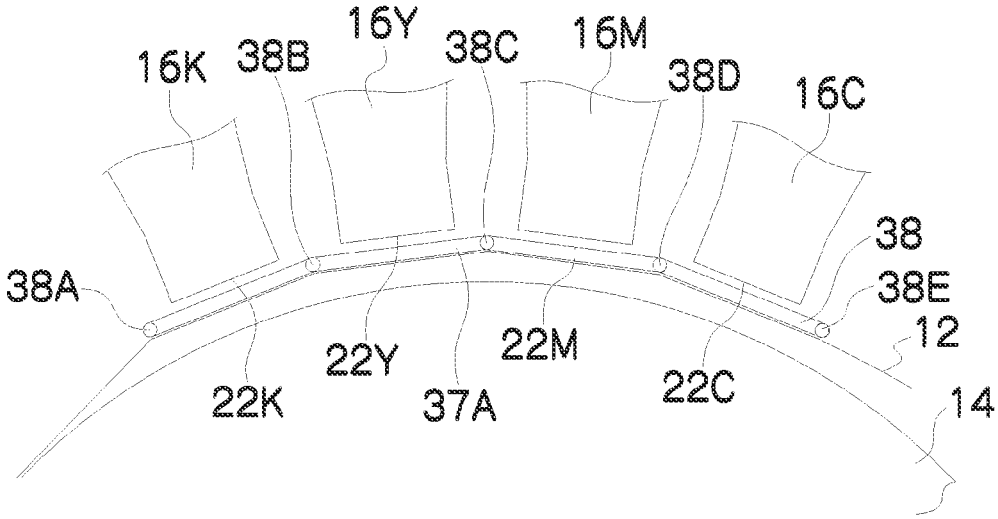
Figure 5:
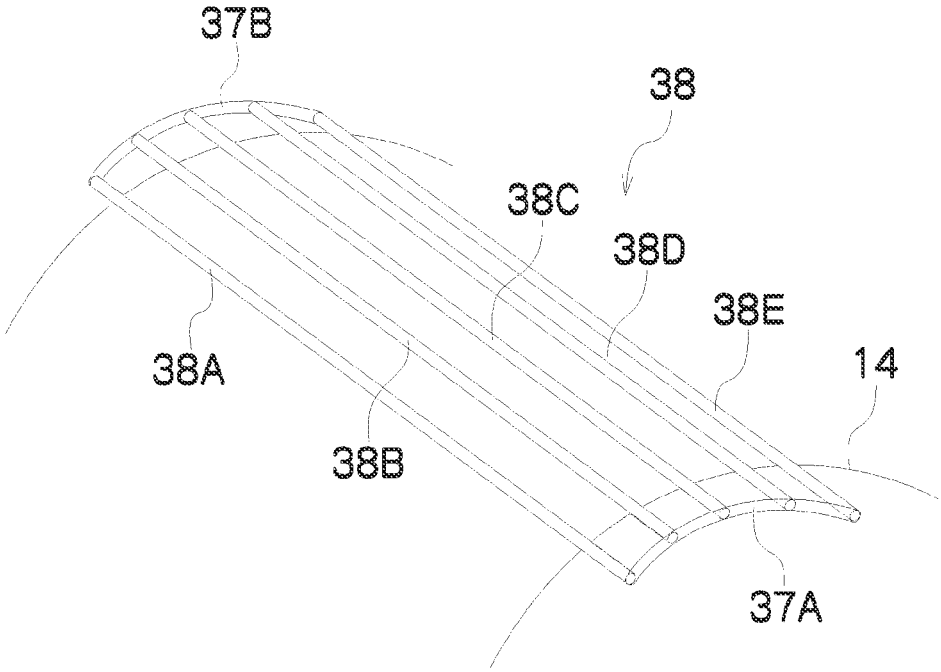
FIG. 5 is a perspective diagram showing the external appearance of a pipe-type protective guide.

FIGS. 4A to 5 are diagrams showing the protective device according to a first embodiment. FIGS. 4A and 4B are schematic front views of the periphery of the circumferential surface or conveyance surface of the image formation drum 14 in the image formation unit 10, and show the image formation drum 14, the line heads 16C, 16M, 16Y and 16K, and the protective device. FIG. 5 is a perspective diagram showing the external appearance of a pipe-type protective guide.

As shown in FIG. 5, the pipe-type protective guide 38, which is formed as a pipe-shaped frame, is used as the protective device. The material of the pipe-type protective guide 38 can be a metal such as aluminum, or a high-strength resin, or the like.

The pipe-type protective guide 38 is constituted of two first pipe members 37A and 37B and five second pipe members 38A, 38B, 38C, 38D and 38E. Each of the first pipe members 37A and 37B has a shape following the circumferential surface of the image formation drum 14 in the direction of conveyance of the paper 12 in the image formation drum 14. The five second pipe members 38A, 38B, 38C, 38D and 38E are arranged so as to bridge the two first pipe members 37A and 37B. The second pipe members 38A, 38B, 38C, 38D and 38E are disposed with a uniform interval therebetween in the direction of conveyance of the paper 12 in the image formation drum 14.

The distance between the two first pipe members 37A and 37B is greater than the length of the nozzle faces 22C, 22M, 22Y and 22K of the line heads 16C, 16M, 16Y and 16K in the direction (the lengthwise direction of the line heads 16C, 16M, 16Y and 16K) perpendicular to the direction of conveyance of the paper 12 in the image formation drum 14.

The uniform interval between the five second pipe members 38A, 38B, 38C, 38D and 38E in the direction of conveyance of the paper 12 in the image formation drum 14 is greater than the breadth of the nozzle faces 22C, 22M, 22Y and 22K of the line heads 16C, 16M, 16Y and 16K. By this means, the second pipe members 38A, 38B, 38C, 38D and 38E are arranged at positions in the adjacent regions on the sides of the nozzle faces 22C, 22M, 22Y and 22K, in other words, at the position behind the nozzle face 22C, at the positions between the nozzle faces 22C, 22M, 22Y and 22K, and at the position in front of the nozzle face 22K, in the direction of conveyance of the paper 12 in the image formation drum 14.

The cross-sectional shape of the first and second pipe members 37A, 37B, 38A, 38B, 38C, 38D and 38E is not limited to a circular shape and can be an elliptical or polygonal shape. Moreover, the first and second pipe members 37A, 37B, 38A, 38B, 38C, 38D and 38E can be either hollow or solid.

Since the pipe-type protective guide 38 is constituted of the first and second pipe members 37A, 37B, 38A, 38B, 38C, 38D and 38E, then it is possible to dispose the members in the narrow gaps between the nozzle faces 22C, 22M, 22Y and 22K.

End parts of the pipe-type protective guide 38 are attached to a pair of main body frames (not shown), which are arranged perpendicularly to the rotating shaft 18 at the ends of the image formation drum 14. The pipe-type protective guide 38 is thereby stationary at a position between the circumferential surface of the image formation drum 14 and the nozzle faces 22C, 22M, 22Y and 22K.

The inkjet recording apparatus 1 is provided with a backup power supply (not shown), and in the event of an interruption of the main power supply, although the rotation and suction in the image formation drum 14 are halted (i.e., the paper 12 is released from the suction toward the circumferential surface of the image formation drum 14), the below-described judgment of the halt of suction in the image formation drum 14 and the movement of the line heads 16C, 16M, 16Y and 16K in the event of the halt of suction can be carried out by means of the back-up power supply.

On the basis of the above-described composition, the pipe-type protective guide 38 has an action as described below.

Firstly, it is supposed that an emergency halt or an interruption of the power supply, or the like, has occurred during image formation, and the rotation and suction in the image formation drum 14 have halted (i.e., the paper 12 has been released from the suction toward the circumferential surface of the image formation drum 14). In this case, the system controller 30 reports to the suction judgment unit 31 that the power supply of the inkjet recording apparatus 1 has been cut off, and the suction judgment unit 31 then judges that the suction in the image formation drum 14 has halted.

Then, according to the judgment by the suction judgment unit 31, the image formation unit controller 32 controls the line heads 16C, 16M, 16Y and 16K to be withdrawn the image formation state shown in FIG. 4A where the ejection faces of the line heads 16C, 16M, 16Y and 16K are situated in the image formation positions to the withdrawn state shown in FIG. 4B. Here, as shown in FIG. 4B, the pipe-type protective guide 38 is arranged at the position closer to the image formation drum 14 than the positions of the nozzle faces 22C, 22M, 22Y and 22K of the line heads 16C, 16M, 16Y and 16K in the withdrawn state, in the direction in which the nozzle faces 22C, 22M, 22Y and 22K face the image formation drum 14.

Hence, even if the paper 12 floats up from the conveyance surface (circumferential surface) of the image formation drum 14, the paper 12 first comes into contact with the second pipe members 38A, 38B, 38C, 38D and 38E of the pipe-type protective guide 38 and is thereby checked at the position between the conveyance surface of the image formation drum 14 and the nozzle faces 22C, 22M, 22Y and 22K, or in the vicinity thereof, this position being closer to the image formation drum 14 than the nozzle faces 22C, 22M, 22Y and 22K. Consequently, due to the presence of the pipe-type protective guide 38, which is inexpensive and has the simple structure, the paper 12 is prevented from coming into contact with the nozzle faces 22C, 22M, 22Y and 22K, and the nozzle faces 22C, 22M, 22Y and 22K are protected.

Figure 6:
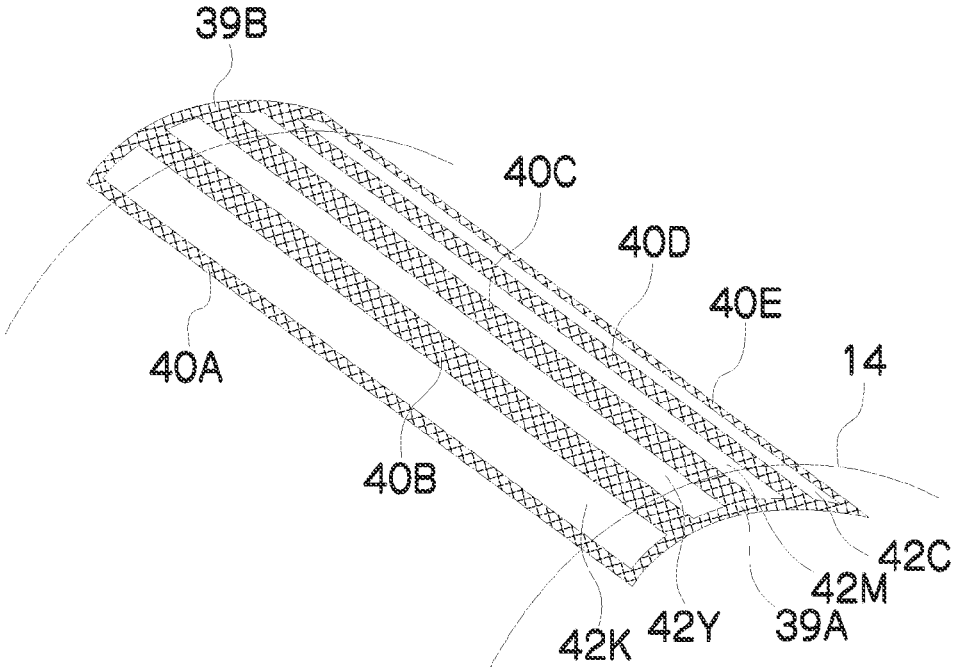
FIG. 6 is a perspective diagram showing the external appearance of a net-type protective guide.
Figure 7A:
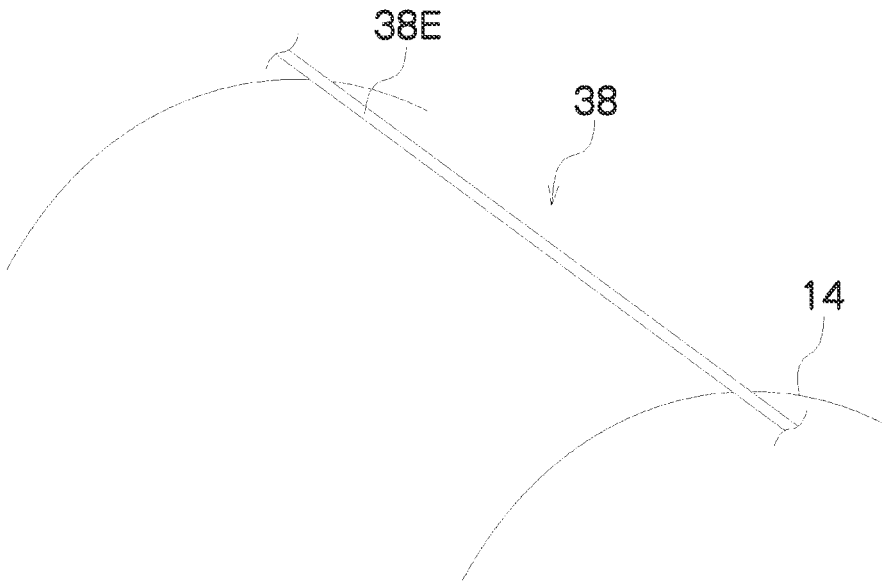
FIGS. 7A and 7B are diagrams showing modifications of the pipe-type protective guide and the net-type protective guide.
Figure 7B:
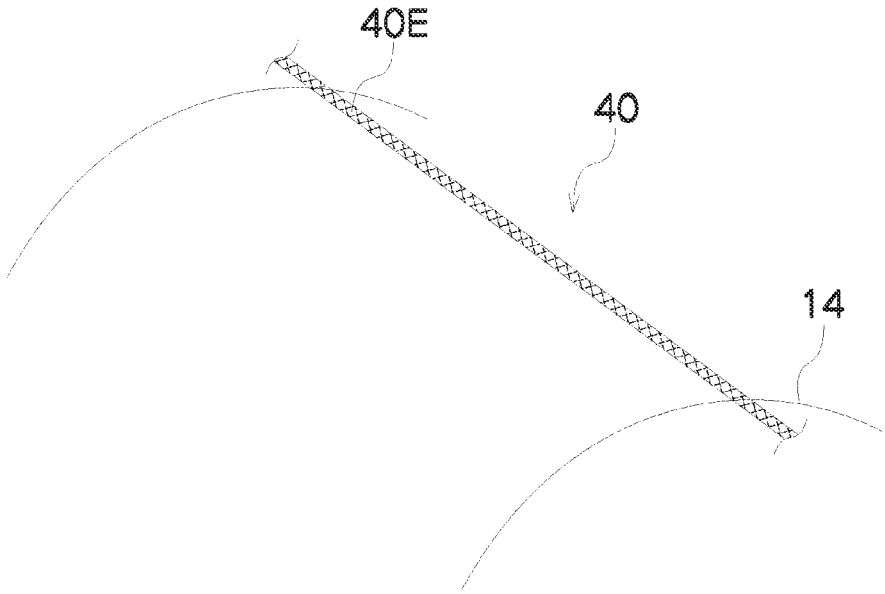

FIG. 6 is a perspective diagram showing the external appearance of the net-type protective guide 40.

As shown in FIG. 6, instead of the pipe-type protective guide 38 described above, it is also possible to use the net-type protective guide 40 in the form of a flat sheet-shaped mesh, as the protective device. The net-type protective guide 40 is a net member which uses first net members 39A and 39B instead of the first pipe members 37A and 37B of the pipe-type protective guide 38, and second net members 40A, 40B, 40C, 40D and 40E instead of the second pipe members 38A, 38B, 38C, 38D and 38E of the pipe-type protective guide 38. The first and second net members 39A, 39B, 40A, 40B, 40C, 40D and 40E are formed into a single body.

Head apertures 42C, 42M, 42Y and 42K to which the line heads 16C, 16M, 16Y and 16K are inserted are formed between the second net members 40A, 40B, 40C, 40D and 40E.

The surface areas of the head apertures 42C, 42M, 42Y and 42K are larger than the cross-sectional areas of the line heads 16C, 16M, 16Y and 16K in the cross-section parallel to the nozzle faces 22C, 22M, 22Y and 22K. Hence, the line heads 16C, 16M, 16Y and 16K are able to move between the image formation position and the withdrawn position such as those shown in FIGS. 4A and 4B, by passing through the head apertures 42C, 42M, 42Y and 42K.

The net-type protective guide 40 has a larger surface area than the pipe-type protective guide 38, and hence the beneficial effects of checking the paper 12 are enhanced.

It is possible to make the pipe-type protective guide 38 and the net-type protective guide 40 movable in the direction perpendicular to the circumferential surface of the image formation drum 14 (the conveyance surface for the paper 12), in the direction in which the line heads 16C, 16M, 16Y and 16K face the image formation drum 14, by means of the protective device drive unit 33. Thus, the pipe-type protective guide 38 and the net-type protective guide 40 can be moved so as to become closer to the circumferential surface of the image formation drum 14 in the event of an abnormality or an interruption of the power supply.

Furthermore, as described above, the second pipe members 38A, 38B, 38C, 38D and 38E of the pipe-type protective guide 38 or the second net members 40A, 40B, 40C, 40D and 40E of the net-type protective guide 40 are arranged at the positions in the adjacent regions on either side of each of the nozzle faces 22C, 22M, 22Y and 22K in the direction of conveyance of the paper 12; however, the arrangement of the members of the protective guides is not limited to this.

For example, as shown in FIGS. 7A to 8B, it is also possible to arrange the second pipe member 38E of the pipe-type protective guide 38 or the second net member 40E of the net-type protective guide 40 only at the position in the adjacent region behind the nozzle face 22C of the line head 16C, which is arranged in the rearmost position among the line heads 16C, 16M, 16Y and 16K in the direction of conveyance of the paper 12.

In the case of the embodiment shown in FIGS. 7A to 8B, management of the halt position of the paper 12 is also carried out, and control is implemented in such a manner that in the event of an abnormality or an interruption of the power supply while the leading end of the paper 12 is being gripped by the gripper 20 and conveyed, the trailing end of the paper 12 is positioned behind the second pipe member 38E or the second net member 40E in the direction of conveyance of the paper 12.

Figure 8A:
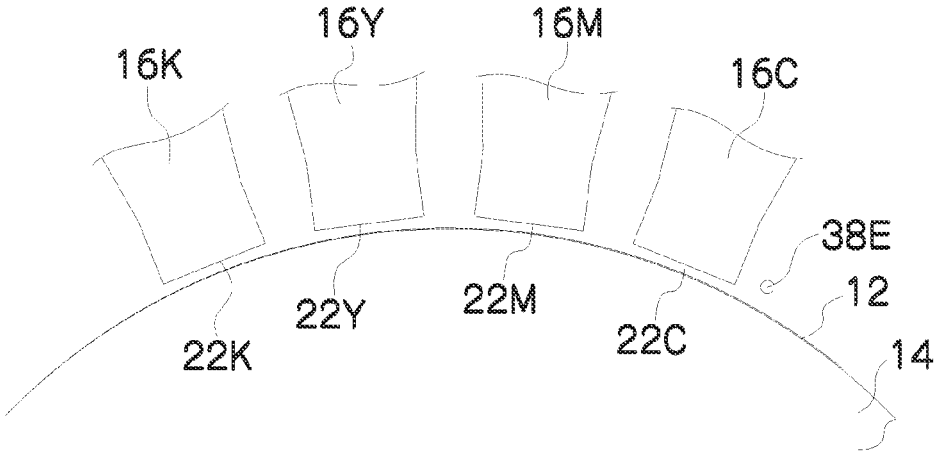
FIGS. 8A and 8B are diagrams showing the action of the modifications in FIGS. 7A and 7B.
Figure 8B:
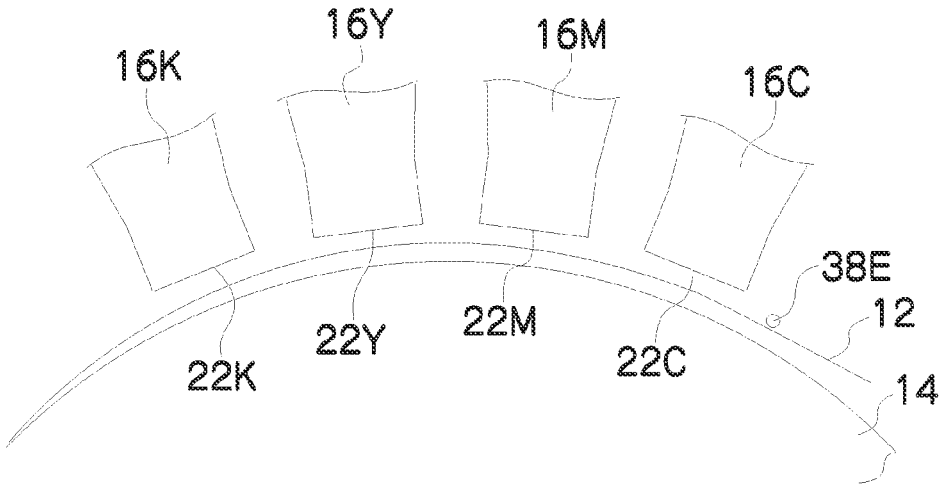
Figure 9A:
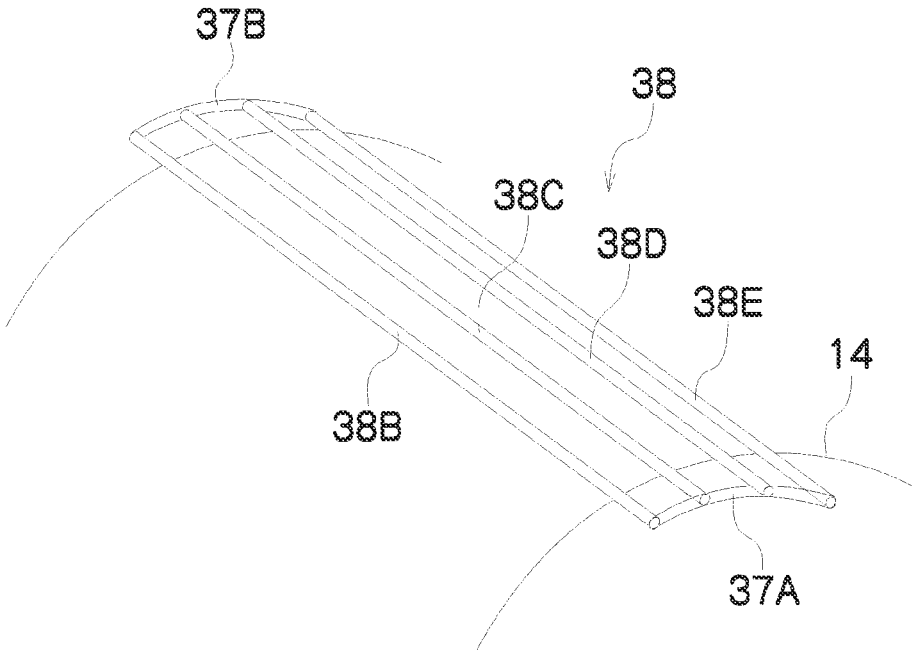
FIGS. 9A and 9B are diagrams showing other modifications of the pipe-type protective guide and the net-type protective guide.
Figure 9B:
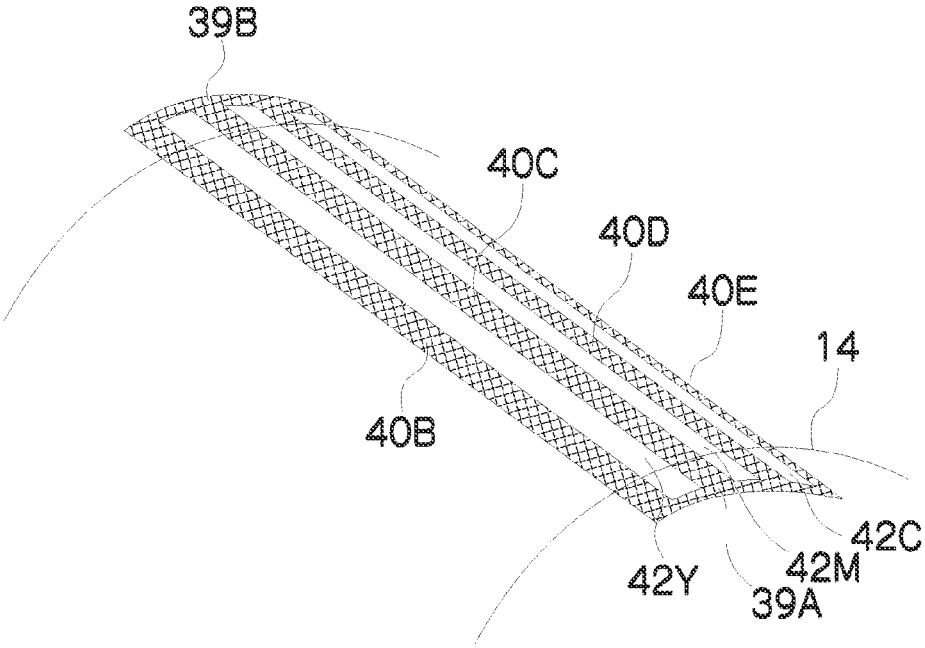

According to this, as shown in FIG. 8B, even if the trailing end of the paper 12 floats up in the event of an abnormality or an interruption of the power supply while the leading end of the paper 12 is being gripped by the gripper 20 and conveyed, since the paper 12 comes into contact with the second pipe member 38E of the pipe-type protective guide 38, then it is possible to protect the nozzle faces 22C, 22M, 22Y and 22K. Similarly, it is possible to protect the nozzle faces 22C, 22M, 22Y and 22K by means of the second net member 40E of the net-type protective guide 40. Furthermore, the installation space can be minimized and costs can be reduced.

Alternatively, as shown in FIGS. 9A to 10B, it is also possible to arrange the second pipe members 38B, 38C, 38D and 38E of the pipe-type protective guide 38 or the second net members 40B, 40C, 40D and 40E of the net-type protective guide 40 only at the positions in the adjacent regions behind respectively the nozzle faces 22C, 22M, 22Y and 22K of the line heads 16C, 16M, 16Y and 16K, in the direction of conveyance of the paper 12.

Figure 10A:
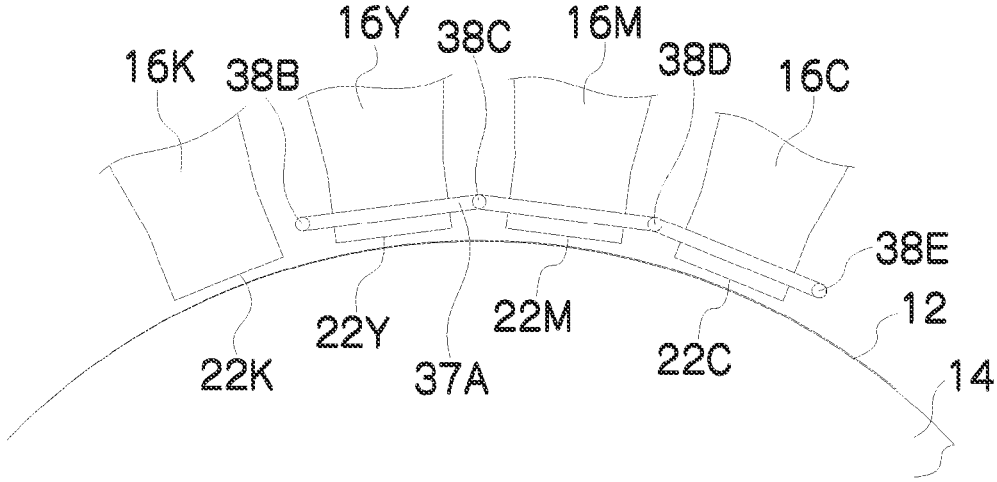
FIGS. 10A and 10B are diagrams showing the action of the modifications in FIGS. 9A and 9B.
Figure 10B:
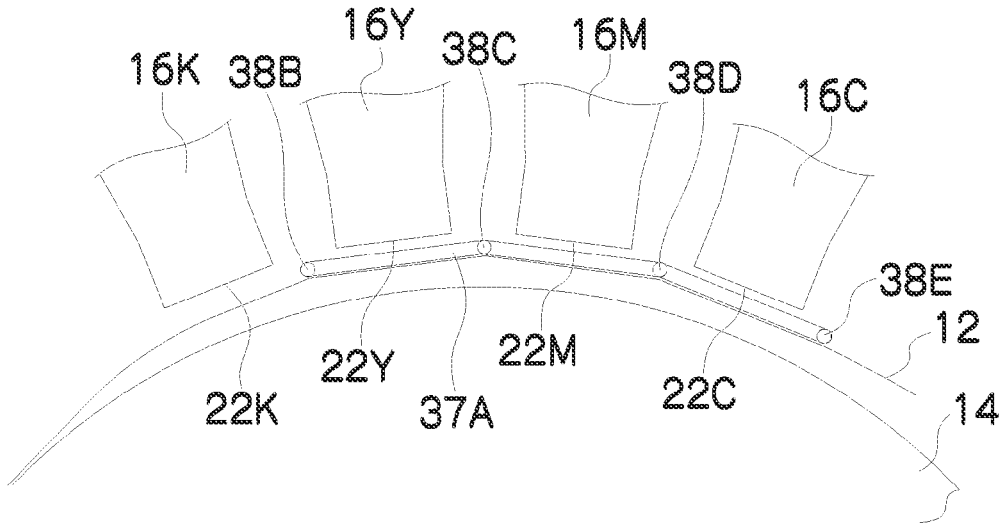

According to this, as shown in FIG. 10B, even if the trailing end of the paper 12 floats up in the event of an abnormality or an interruption of the power supply while the leading end of the paper 12 is being gripped by the gripper 20 and conveyed, since the paper 12 comes into contact with the second pipe members 38B, 38C, 38D and 38E of the pipe-type protective guide 38, then it is possible to protect the nozzle faces 22C, 22M, 22Y and 22K. Similarly, it is possible to protect the nozzle faces 22C, 22M, 22Y and 22K by means of the second net members 40B, 40C, 40D and 40E of the net-type protective guide 40. Furthermore, the installation space can be minimized and costs can be reduced.

Moreover, the pipe-type protective guide 38 and the net-type protective guide 40 have the lengths equal to or greater than the entire length of the image formation drum 14 in the direction perpendicular to the direction of conveyance of the paper 12; however, the length of the protective guide is not limited to this, and the protective guide can be formed only to a length corresponding to a portion of the length of the image formation drum 14, from either end of the image formation drum 14, in the direction perpendicular to the direction of conveyance of the paper 12.

Furthermore, if the paper 12 is conveyed while being held by suction only on the image formation drum 14, without being gripped by a gripper 20, then it is thought that the leading part of the paper 12, or all of the paper 12, can float up from the conveyance surface of the image formation drum 14 in the event of an abnormality or an interruption of the power supply. Therefore, in this case, it is desirable that the second pipe member 38A of the pipe-type protective guide 38 or the second net member 40A of the net-type protective guide 40 is also arranged. Consequently, it is desirable to arrange the second pipe members 38A, 38B, 38C, 38D and 38E or the second net members 40A, 40B, 40C, 40D and 40E, as shown in FIGS. 4A to 6.

Second Embodiment

Figure 11A:
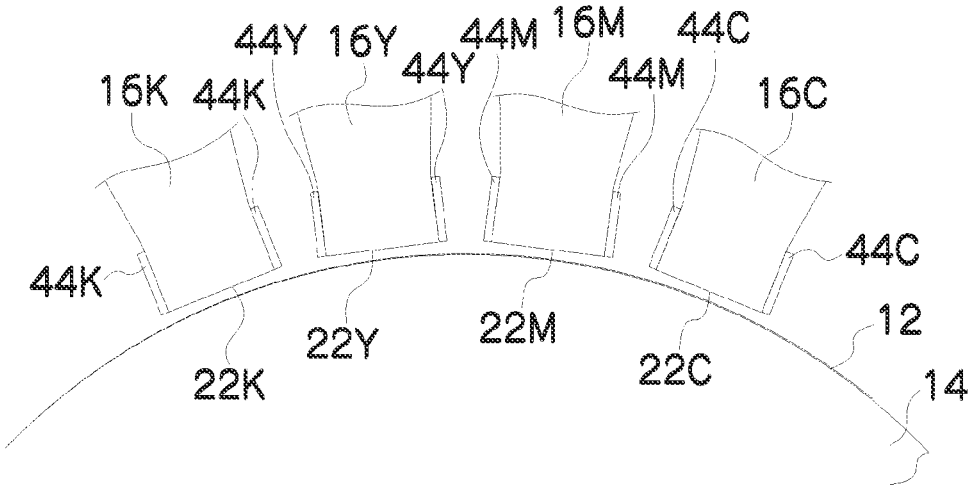
FIGS. 11A and 11B are diagrams showing a second embodiment of the protective device.
Figure 11B:
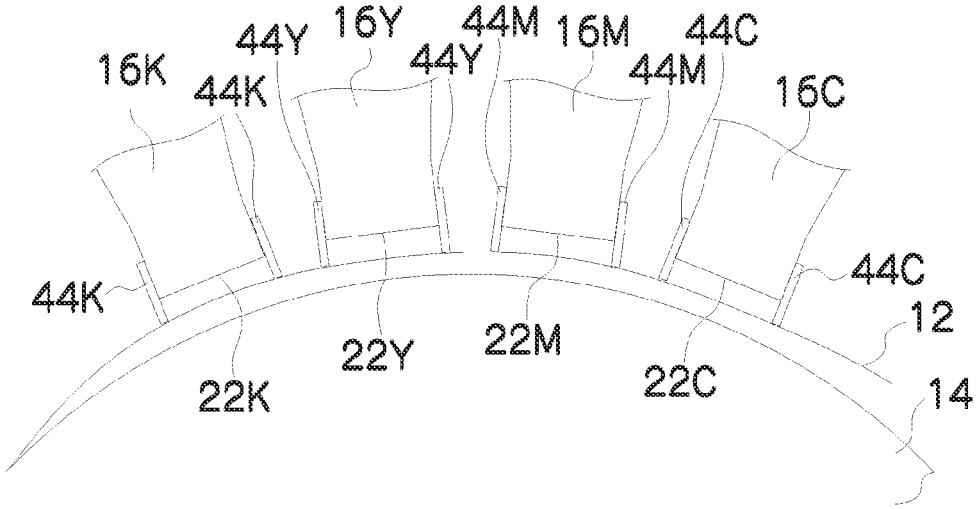

FIGS. 11A and 11B are diagrams showing a second embodiment of the protective device.

As shown in FIGS. 11A and 11B, protective plates 44C, 44M, 44Y and 44K are used as the protective device in the second embodiment. The material of the protective plates 44C, 44M, 44Y and 44K can be a metal such as aluminum, or a high-strength resin, or the like. In FIGS. 11A and 11B, the protective plates 44C, 44M, 44Y and 44K are arranged on the side flanks of the line heads 16C, 16M, 16Y and 16K, and more specifically, the lateral side faces of the line heads 16C, 16M, 16Y and 16K, in the direction of conveyance of the paper 12.

The protective plates 44C, 44M, 44Y and 44K are arranged along the lengthwise direction of the line heads 16C, 16M, 16Y and 16K (the direction perpendicular to the direction of conveyance of the paper 12), and have lengths substantially equal to the entire lengths of the line heads 16C, 16M, 16Y and 16K.

The protective plates 44C, 44M, 44Y and 44K can be moved relatively in the vertical direction with respect to the line heads 16C, 16M, 16Y and 16K, in the direction in which the line heads 16C, 16M, 16Y and 16K face the image formation drum 14.

The inkjet recording apparatus 1 is provided with a backup power supply (not shown), and in the event of an interruption of the main power supply, although the rotation and suction in the image formation drum 14 are halted (i.e., the paper 12 is released from the suction toward the circumferential surface of the image formation drum 14), the judgment of the halt of suction in the image formation drum 14 and the movement of the line heads 16C, 16M, 16Y and 16K (or the protective plates 44C, 44M, 44Y and 44K) in the event of the halt of suction can be carried out by means of the back-up power supply.

On the basis of the above-described composition, the protective plates 44C, 44M, 44Y and 44K have actions as described below.

Firstly, it is supposed that an emergency halt or an interruption of the power supply, or the like, has occurred during image formation, and the rotation and suction in the image formation drum 14 have halted (i.e., the paper 12 has been released from the suction toward the circumferential surface of the image formation drum 14). In this case, the system controller 30 reports to the suction judgment unit 31 that the power supply of the inkjet recording apparatus 1 has been cut off, and the suction judgment unit 31 then judges that the suction in the image formation drum 14 has halted.

Then, according to the judgment by the suction judgment unit 31, the image formation unit controller 32 controls the line heads 16C, 16M, 16Y and 16K to be withdrawn from the image formation state shown in FIG. 11A where the ejection faces of the line heads 16C, 16M, 16Y and 16K are situated in the image formation positions to the withdrawn state shown in FIG. 11B, and the image formation unit controller 32 also controls the protective plates 44C, 44M, 44Y and 44K to move toward the circumferential surface of the image formation drum 14.

Hence, even if the paper 12 floats up from the conveyance surface (circumferential surface) of the image formation drum 14, the paper 12 first comes into contact with the protective plates 44C, 44M, 44Y and 44K, and is thereby checked at the position between the conveyance surface of the image formation drum 14 and the nozzle faces 22C, 22M, 22Y and 22K, or in the vicinity thereof, this position being closer to the image formation drum 14 than the nozzle faces 22C, 22M, 22Y and 22K. Consequently, due to the presence of the protective plates 44C, 44M, 44Y and 44K, which are inexpensive and have the simple structure, the paper 12 is prevented from coming into contact with the nozzle faces 22C, 22M, 22Y and 22K, and the nozzle faces 22C, 22M, 22Y and 22K are protected.

Since the protective plates 44C, 44M, 44Y and 44K are arranged on the lateral side faces of the line heads 16C, 16M, 16Y and 16K, and the nozzle faces 22C, 22M, 22Y and the 22K are exposed, then it is possible to wipe and clean the nozzle faces 22C, 22M, 22Y and 22K by pressing wiping webs (not shown) against the nozzle faces 22C, 22M, 22Y and 22K, without being affected by the protective plates 44C, 44M, 44Y and 44K, when the line heads 16C, 16M, 16Y and 16K are moved from the image formation position to the maintenance position.

Moreover, it is also possible to withdraw the line heads 16C, 16M, 16Y and 16K from the image formation position to the withdrawn position, and to keep the protective plates 44C, 44M, 44Y and 44K stationary.

Further, it is also possible to move the protective plates 44C, 44M, 44Y and 44K so as to become nearer to the circumferential surface of the image formation drum 14, while the line heads 16C, 16M, 16Y and 16K remain stationary at the image formation position.

Furthermore, as described above, the protective plates 44C, 44M, 44Y and 44K are arranged on the lateral side faces of the line heads 16C, 16M, 16Y and 16K in the direction of conveyance of the paper 12; however, the arrangement of the protective plates is not limited to this.

Figure 12A:
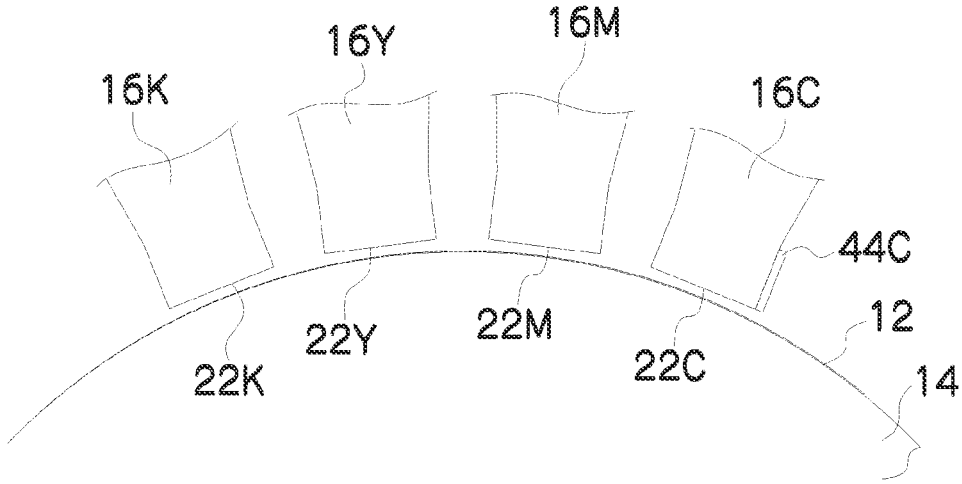
FIGS. 12A and 12B are diagrams showing a modification of a plate-type protective device and the action thereof.

For example, as shown in FIG. 12A, it is also possible to arrange the protective plate 44C only on the rear side face of the line head 16C, which is arranged in the rearmost position among the line heads 16C, 16M, 16Y and 16K, in the direction of conveyance of the paper 12.

Figure 12B:
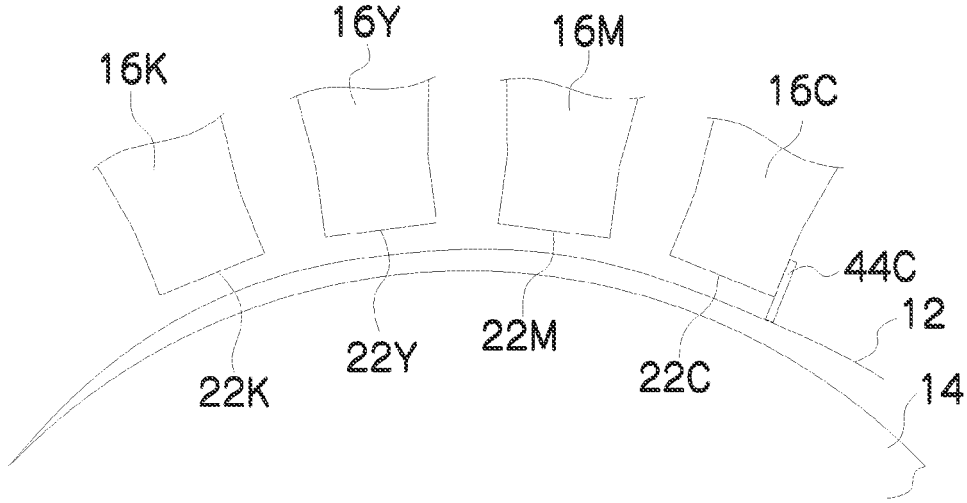

In the case of the embodiment shown in FIGS. 12A and 12B, management of the halt position of the paper 12 is also carried out, and control is implemented in such a manner that in the event of an abnormality or an interruption of the power supply while the leading end of the paper 12 is being gripped by the gripper 20 and conveyed, the trailing end of the paper 12 is positioned behind the protective plate 44C in the direction of conveyance of the paper 12.

According to this, as shown in FIG. 12B, even if the trailing end of the paper 12 floats up in the event of an abnormality or an interruption of the power supply while the leading end of the paper 12 is being gripped by the gripper 20 and conveyed, since the paper 12 comes into contact with the protective plate 44C, then it is possible to protect the nozzle faces 22C, 22M, 22Y and 22K. Furthermore, the installation space can be minimized and costs can be reduced.

Figure 13A:
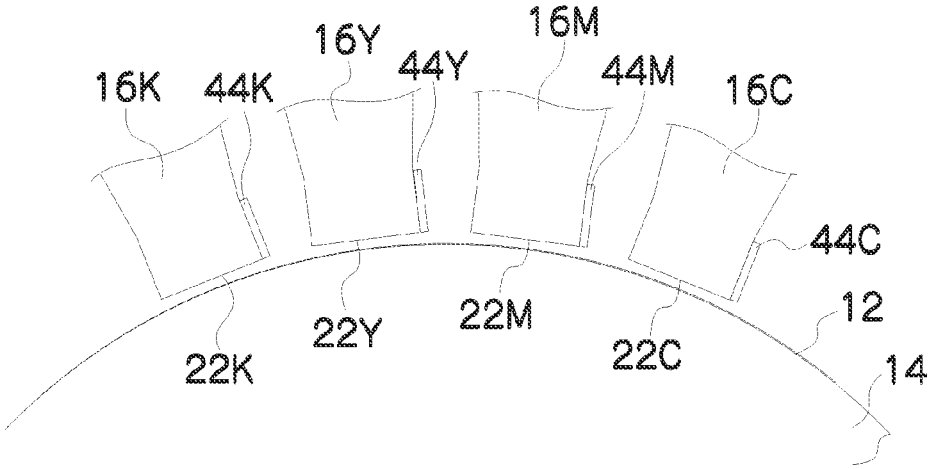
FIGS. 13A and 13B are diagrams showing another modification of the plate-type protective device and the action thereof.

Alternatively, as shown in FIG. 13A, it is also possible to arrange the protective plates 44C, 44M, 44Y and 44K only on the rear side faces of the line heads 16C, 16M, 16Y and 16K in terms of the direction of conveyance of the paper 12.

Figure 13B:
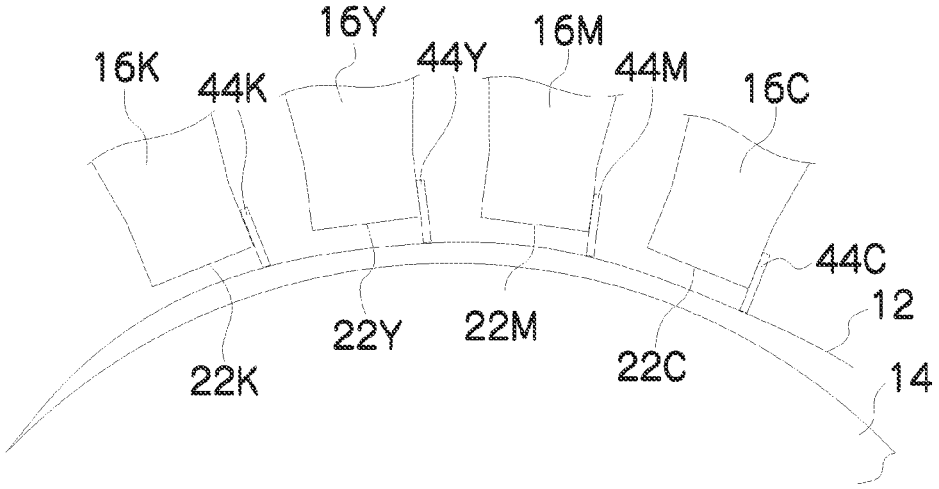

According to this, as shown in FIG. 13B, even if the trailing end of the paper 12 floats up in the event of an abnormality or an interruption of the power supply while the leading end of the paper 12 is being gripped by the gripper 20 and conveyed, since the paper 12 comes into contact with the protective plates 44C, 44M, 44Y and 44K, then it is possible to protect the nozzle faces 22C, 22M, 22Y and 22K. Furthermore, the installation space can be minimized and costs can be reduced.

Moreover, each of the protective plates 44C, 44M, 44Y and 44K has the length substantially equal to the entire length of the image formation drum 14 in the direction perpendicular to the direction of conveyance of the paper 12; however, the length is not limited to this, and each protective plate may also be formed only to a length corresponding to a portion of the length of the image formation drum 14, from either end of the image formation drum 14, in the direction perpendicular to the direction of conveyance of the paper 12.

Furthermore, if the paper 12 is conveyed while being held by suction only on the image formation drum 14, without being gripped by a gripper 20, then it is thought that the leading part of the paper 12, or all of the paper 12, can float up from the conveyance surface of the image formation drum 14 in the event of an abnormality or an interruption of the power supply. Therefore, in this case, it is desirable that the protective plates 44C, 44M, 44Y and 44K are arranged also on the front sides of the nozzle faces 22C, 22M, 22Y and 22K in the direction of conveyance of the paper 12. Consequently, it is desirable to arrange the protective plates 44C, 44M, 44Y and 44K on both lateral side faces of the nozzle faces 22C, 22M, 22Y and 22K in the direction of conveyance of the paper 12, as shown in FIGS. 11A and 11B.

Although the mode using the four line heads has been described in the embodiments, but the present invention can be applied without restriction in terms of the number of line heads used.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, a movement device which changes a relative positional relationship of the ejection face protective device and the ejection face of the liquid ejection head, wherein when the recording medium is released from the suction toward the circumferential surface of the cylindrical conveyance member, the movement device moves the ejection face protective device to the position in the one of the first region and the second region.

2. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, wherein the restricting member is disposed through an entire length of the liquid ejection head in a direction perpendicular to the conveyance direction of the recording medium.

3. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, wherein the restricting member includes two first pipe members and a second pipe member bridging the two first pipe members, each of the two first pipe members having a shape following the circumferential surface of the cylindrical conveyance member along the conveyance direction of the recording medium in the periphery of the ejection face of the liquid ejection head.

4. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, wherein the restricting member includes a mesh-shaped member, the mesh-shaped member having an aperture which has a shape similar to the ejection face of the liquid ejection head and is larger than the ejection face of the liquid ejection head.

5. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, wherein the restricting member is arranged at a position on a rear side of the liquid ejection head in terms of the conveyance direction of the recording medium.

6. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member, wherein the restricting member is arranged to encompass positions on both sides of the liquid ejection head in terms of the conveyance direction of the recording medium.

7. An image formation apparatus, comprising:

a cylindrical conveyance member which conveys a recording medium in a conveyance direction while rotating in a state where the recording medium is held by suction on a circumferential surface of the cylindrical conveyance member;

a liquid ejection head which ejects liquid from an ejection face thereof toward the recording medium being conveyed by the cylindrical conveyance member; and an ejection face protective device which is disposed in a periphery of the ejection face of the liquid ejection head, the ejection face protective device including a restricting member which restricts floating up of the recording medium by coming in contact with the recording medium at a position in one of a first region between the ejection face of the liquid ejection head and the circumferential surface of the cylindrical conveyance member, and a second region adjacent to the first region, when the recording medium is released from the suction toward the circumferential surface of the cylindrical conveyance member while being conveyed by the cylindrical conveyance member;

a plurality of the liquid ejection heads, wherein the restricting member is arranged at a position on a rear side of a rearmost one of the plurality of the liquid ejection heads in terms of the conveyance direction of the recording medium.

8. An inkjet recording apparatus, comprising:

a treatment liquid deposition unit which deposits treatment liquid onto a recording medium;

an image formation unit including: a cylindrical conveyance member which conveys the recording medium on which the treatment liquid has been deposited by the treatment liquid deposition unit, in a conveyance direction while rotating in a state where the recording medium is held by suction on a circumferential surface of the cylindrical conveyance member; an ink ejection head which ejects ink from an ejection face thereof toward the recording medium being conveyed by the cylindrical conveyance member; and an ejection face protective device which is disposed in a periphery of the ejection face of the ink ejection head, the ejection face protective device including a restricting member which restricts floating up of the recording medium by coming in contact with the recording medium at a position in one of a first region between the ejection face of the ink ejection head and the circumferential surface of the cylindrical conveyance member, and a second region adjacent to the first region, when the recording medium is released from the suction toward the circumferential surface of the cylindrical conveyance member while being conveyed by the cylindrical conveyance member; and a drying unit which dries the ink having been deposited on the recording medium in the image formation unit.

* * * * *